US012188395B2

(12) United States Patent
Jibb et al.

(10) Patent No.: US 12,188,395 B2
(45) Date of Patent: Jan. 7, 2025

(54) RECUPERATIVE HEAT EXCHANGER SYSTEM

(71) Applicant: Lummus Technology LLC, Bloomfield, NJ (US)

(72) Inventors: Richard John Jibb, Bloomfield, NJ (US); David Guymon, Bloomfield, NJ (US); Ron Herbanek, Bloomfield, NJ (US); Vincenzo Marco Brignone, Bloomfield, NJ (US); Roberto Groppi, Bloomfield, NJ (US)

(73) Assignee: Lummus Technology LLC, Bloomfield, NJ (US)

( * ) Notice: Subject to any disclaimer, the term of this patent is extended or adjusted under 35 U.S.C. 154(b) by 0 days.

(21) Appl. No.: 18/336,688

(22) Filed: Jun. 16, 2023

(65) Prior Publication Data

US 2023/0332523 A1 Oct. 19, 2023

Related U.S. Application Data

(63) Continuation of application No. 17/321,247, filed on May 14, 2021, now Pat. No. 11,719,141.

(60) Provisional application No. 63/045,697, filed on Jun. 29, 2020.

(51) Int. Cl.

| | |
|---|---|
| ***F01N 3/02*** | (2006.01) |
| ***F01N 5/02*** | (2006.01) |
| ***F28D 1/04*** | (2006.01) |
| ***F28D 21/00*** | (2006.01) |

(52) U.S. Cl.

CPC ..... *F01N 3/0205* (2013.01); *F01N 5/02* (2013.01); *F28D 1/0408* (2013.01); *F28D 21/001* (2013.01); *F24F 2221/54* (2013.01)

(58) Field of Classification Search

CPC ..... F01N 3/0205; F01N 5/02; F28D 1/0408; F28D 21/001; F24F 2221/54

USPC ..... 165/100

See application file for complete search history.

(56) References Cited

U.S. PATENT DOCUMENTS

| | | | |
|---|---|---|---|
| 848,044 | A | 3/1907 | Patrick |
| 1,757,343 | A | 5/1930 | Steinmüller |
| 1,961,233 | A | 6/1934 | Mayr |
| 2,056,492 | A | 10/1936 | Stout |
| 2,204,144 | A | 6/1940 | Moore et al. |

(Continued)

FOREIGN PATENT DOCUMENTS

| | | | |
|---|---|---|---|
| CN | 105247174 | A | 1/2016 |
| DE | 3441972 | A1 | 5/1986 |

(Continued)

OTHER PUBLICATIONS

International Search Report, issued in Internationl Applicatioon No. PCT/US2021/032580, dated Oct. 21, 2021 (5 pages).

(Continued)

*Primary Examiner* — Jon T. Schermerhorn, Jr.
(74) *Attorney, Agent, or Firm* — Seed IP Law Group LLP

(57) ABSTRACT

A system may include a turbine and a recuperative heat exchanger system. The recuperative heat exchanger system is configured to receive exhaust gases from the turbine. The recuperative heat exchanger system may include a precool section to cool the exhaust gases, a major heating section to receive the cooled the exhaust gases, and a minor heating section to receive the cooled the exhaust gases.

20 Claims, 5 Drawing Sheets

(56) References Cited

U.S. PATENT DOCUMENTS

| | | | | |
|---|---|---|---|---|
| 2,876,975 | A | 3/1959 | Short | |
| 2,920,873 | A | 1/1960 | Schluderberg et al. | |
| 2,962,007 | A | 11/1960 | Koch | |
| 3,208,436 | A | 9/1965 | Godshalk | |
| 3,479,994 | A | 11/1969 | Kreider et al. | |
| 3,526,274 | A | 9/1970 | Gardner | |
| 3,814,063 | A | 6/1974 | Bijmholt | |
| 4,236,574 | A | 12/1980 | Bosne | |
| 4,539,940 | A | 9/1985 | Young | |
| 5,203,405 | A | 4/1993 | Gentry et al. | |
| 6,189,608 | B1 | 2/2001 | Bodas et al. | |
| 6,305,330 | B1 | 10/2001 | Darling | |
| 6,532,745 | B1 | 3/2003 | Neary | |
| 6,629,413 | B1 | 10/2003 | Wendt et al. | |
| 7,240,640 | B2 | 7/2007 | Kinnunen | |
| 8,272,429 | B2 | 9/2012 | Inatomi et al. | |
| 8,596,075 | B2 | 12/2013 | Allam et al. | |
| 8,661,780 | B2 | 3/2014 | Wettstein et al. | |
| 8,959,887 | B2 * | 2/2015 | Allam | F23R 3/005 60/39.5 |
| 9,657,604 | B2 * | 5/2017 | Sjödin | F01K 23/10 |
| 10,018,115 | B2 | 7/2018 | Allam et al. | |
| 10,309,643 | B2 * | 6/2019 | Shimono | E04H 9/0215 |
| 10,415,434 | B2 | 9/2019 | Allam et al. | |
| 10,422,252 | B2 | 9/2019 | Allam et al. | |
| 10,711,695 | B2 | 7/2020 | Allam et al. | |
| 11,073,080 | B2 * | 7/2021 | Conlon | F02C 6/16 |
| 2008/0028723 | A1 * | 2/2008 | Nakamitsu | F22B 37/24 52/745.05 |
| 2012/0023893 | A1 | 2/2012 | Yoo et al. | |
| 2012/0023947 | A1 | 2/2012 | Kulkarni et al. | |
| 2016/0053721 | A1 | 2/2016 | Fletcher et al. | |
| 2017/0152765 | A1 | 6/2017 | Uechi et al. | |
| 2018/0073434 | A1 | 3/2018 | Allam et al. | |
| 2018/0073723 | A1 | 3/2018 | Lankinen | |
| 2018/0106473 | A1 | 4/2018 | Shimono et al. | |
| 2018/0230904 | A1 | 8/2018 | Conlon | |
| 2019/0063319 | A1 * | 2/2019 | Forrest | F02C 1/08 |
| 2021/0087949 | A1 * | 3/2021 | Han | F01K 23/103 |

FOREIGN PATENT DOCUMENTS

| | | | |
|---|---|---|---|
| EA | 200101136 | A1 | 4/2002 |
| EA | 201400520 | A1 | 10/2014 |
| EA | 201790148 | A1 | 7/2017 |
| EP | 0 764 814 | A1 | 3/1997 |
| EP | 0 990 780 | A1 | 4/2000 |
| EP | 1 703 041 | A1 | 9/2006 |
| JP | H08-285206 | A | 11/1996 |
| JP | 2001-304785 | A | 10/2001 |
| JP | 2003-035164 | A | 2/2003 |
| RU | 179529 | U1 | 5/2018 |
| RU | 2690308 | C1 | 5/2019 |
| WO | 2007/097573 | A1 | 8/2007 |
| WO | 2019165807 | A1 | 9/2019 |

OTHER PUBLICATIONS

Shepstone, T., "Turning Natural Gas Into Water: Hydraulic Fracturing Doesn't Deplete Water Supplies," Apr. 2012, URL=https://www.energyindepth.org/turning-natural-gas-into-water- hydraulic-fracturing-doesn't-deplete-water-supplies-2/, 5 pages.

Written Opinion, issued in International Application No. PCT/US2021/032580, dated Oct. 21, 2021 (7 pages).

* cited by examiner

RECUPERATIVE HEAT EXCHANGER SYSTEM

BACKGROUND

Thermal power cycles typically use either air breathing gas turbine direct fired Brayton Cycle or indirectly heated closed Rankine Cycle with steam as a working fluid. High efficiencies are obtained by combining the Brayton cycle with a bottoming Rankine Cycle to form a combined cycle. Whilst combined cycle power generation may achieve high efficiency, combined cycle power generation is not suitable for CO2 capture, and the installation can have high capital cost due to the large amount of equipment and pipe work required. In some case, a Supercritical CO2 (SCCO2) Brayton thermal power cycle may be used over the thermal power cycles. Advantageously, Supercritical CO2 (SCCO2) Brayton thermal power cycle may have reduced Greenhouse Gas (GHG) emissions, improved carbon capture, higher efficiency, reduced footprint and lower water consumption. However, there are several technical challenges that must be overcome before the benefits of Supercritical CO2 (SCCO2) Brayton thermal power cycle may be realized. In particular, the design and operation of recuperative heat exchangers for these Supercritical CO2 (SCCO2) Brayton thermal power cycles are an ongoing area of research and development.

A semi-closed direct fired oxy-fuel Brayton cycle may be called an Allam Power Cycle or Allam Cycle. The Allam Cycle is a process for converting fossil fuels into mechanical power, while capturing the generated carbon dioxide and water. Conventionally, the Allam Cycle requires an economizer heat exchanger and an additional low-grade external heat source to achieve high efficiency comparable to existing combined cycle-based technology, with the crucial added benefit of CO2 capture for use or storage. The efficiency of the Allam Cycle is increased if the turbine is operated at higher temperatures typically above 600° C. and at high pressure of 120 to 400 bar. These conditions lead to the simultaneous requirements of high-pressure high temperature and high effectiveness for the heat exchange system. Typically, multiple individual heat exchange units are required, and must be arranged in a network to achieve the required recuperative heat exchange simultaneously with heat recovery from the external low-grade heat source. Examples of conventional heat exchanger systems and methods may be found in U.S. Pat. Nos. 8,272,429; 8,596,075; 8,959,887; 10,018,115; 10,422,252; and U.S. Pat. Pub. No. 2019/0063319. All of which are incorporated herein by reference.

Conventionally, heat exchanger systems may be split into high, medium and low temperature sections. Whilst it is desirable to cool the exhaust gas in the high temperature section to the lowest temperature (for instance a temperature coincident with the low grade heat source temperature), this is in conflict with the mechanical requirements that drive the layout, cost and reliability of such a system. Typically, the design temperature and pressure of the high temperature section are set by the highest temperature and pressure which in turn drives the mechanical requirements.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a recuperative heat exchanger system. The recuperative heat exchanger system may include a precool section within a first rigid framework, a minor section within a third rigid framework, and a first major section within a second rigid framework. The precool section may include one or more heat exchangers to receive and cool exhaust gases. The minor section may include a first minor heat exchanger and a second minor heat exchanger. The first major section may include a first major heat exchanger, a second major heat exchanger, and a third major heat exchanger.

In another aspect, embodiments disclosed herein relate to a method. The method may include cooling exhaust gases with a precool section within a first rigid framework; splitting the exhaust gases, with a manifold positioned outside of the first rigid framework, to flow into a first major section within a second rigid framework, a second major section within a third rigid framework, and a minor section within a third rigid framework; flowing the exhaust gases, in the minor section, through a first minor heat exchanger of the minor section and to a second minor heat exchanger of the minor section via one or more curved flow loops; flowing the exhaust gases, in the first major section, through a first major heat exchanger of the first major section and to a second major heat exchanger of the first major section and then a third major heat exchanger of the first major section via one or more curved flow loops; flowing the exhaust gases, in the second major section, through a first major heat exchanger of the second major section and to a second major heat exchanger of the second major section and then a third major heat exchanger of the second major section via one or more curved flow loops; flowing the exhaust gases from the second minor heat exchanger, the third major heat exchanger of the first major section, and the third major heat exchanger of the second major section to an exhaust gas manifold via secondary curved flow loops.

Other aspects and advantages of the invention will be apparent from the following description and the appended claims.

DETAILED DESCRIPTION

Figure 1:
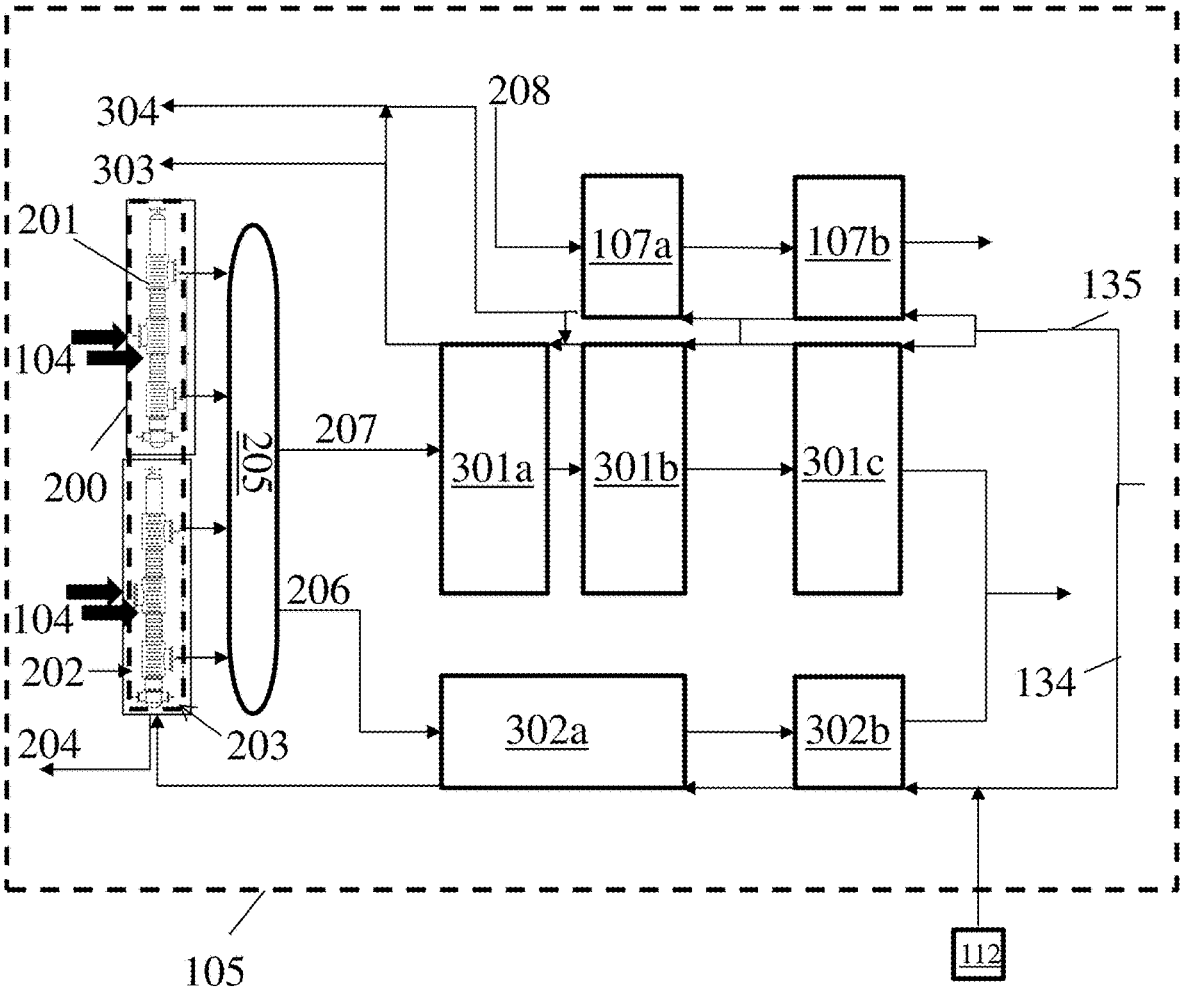
FIG. 1 illustrates a schematic view of a recuperative heat exchanger system in accordance with one or more embodiments of the present disclosure.

Embodiments of the present disclosure are described below in detail with reference to the accompanying figures. Like elements in the various figures may be denoted by like reference numerals for consistency. Further, in the following detailed description, numerous specific details are set forth in order to provide a more thorough understanding of the claimed subject matter. However, it will be apparent to one having ordinary skill in the art that the embodiments described may be practiced without these specific details. In other instances, well-known features have not been described in detail to avoid unnecessarily complicating the description. As used herein, the term "coupled" or "coupled to" or "connected" or "connected to" may indicate establishing either a direct or indirect connection and is not limited to either unless expressly referenced as such. As used herein, fluids may refer to slurries, liquids, gases, and/or mixtures thereof. Wherever possible, like or identical reference numerals are used in the figures to identify common or the same elements. The figures are not necessarily to scale, and certain features and certain views of the figures may be shown exaggerated in scale for purposes of clarification.

In one aspect, embodiments disclosed herein relate to a recuperative heat exchanger system for electricity generation, petrochemical plants, waste heat recovery, and other industrial applications. The recuperative heat exchanger system may also be interchangeably referred to as a network or assembly of heat exchangers in the present disclosure. Additionally, the recuperative heat exchanger system may incorporate a precooling section to reduce turbine exhaust gas temperature. The recuperative heat exchanger system may minimize life cycle cost of heat exchangers that are critical to efficient recuperative thermal energy exchange at high pressure and with high thermal effectiveness. In some embodiments, the recuperative heat exchanger system may be used for Supercritical Carbon Dioxide (SCCO2) power cycles, such as an Allam cycle.

Recuperative heat exchanger systems, according to embodiments herein, may include a combination of Printed Circuit type (PCHE) and Shell and Tube type (STHE) heat exchangers. For example, the recuperative heat exchanger system may include a precool section, a major heating section (recycle heating), a minor heating section (oxidant heating), and a heat recovery section.

In one or more embodiments, the recuperative heat exchanger system may use a heat exchanger network that incorporates parallel sections for heating of a minor portion of a high-pressure gas and a major portion of the high-pressure gas. The minor portion may consist of the oxygen containing CO2 (Oxidant) and the major portion may consist of the balance of the recirculated CO2 (Recycle CO2). The two parallel sections may have substantially different temperature profiles. In a non-limiting example, the major portion (about 75% of a total flow, in a range 51-90%) may be heated to a lower temperature than the minor portion. The minor portion may be first heated to an intermediate temperature approximate 440° C. (in a range of 350-550° C.) before being used to precool the entire high temperature exhaust stream from a high temperature approximate 600° C. (in a range of 550-850° C.) to a temperature low enough to avoid a significant mechanical design constraint, and in particular to a temperature below 575° C. The 575° C. limit may represent a mechanical design constraint when diffusion bonded PCHE are employed and are fabricated from austenitic stainless steel and in particular alloy 316/316L. PCHE alloy 316 blocks may require allowable stresses that are determined from time dependent (creep) properties at temperatures above 575° C. Further, a heat recovery section may be provided in the recuperative heat exchanger system. The heat recovery section may add heat at a temperature below the combustion temperature, e.g. low-grade heat.

Conventional power generation systems in industrial applications are typically very large and heavy. Conventional power generation systems may include an extensive layout and arrangement of pipes that require a large space and weigh several tons each. In some instances, such systems may include large heat exchangers connected in series and may include complicated bends or changes in orientation. Additionally, large manifolds are needed to introduce fluids into the heat exchanges as well as when the fluids exit the heat exchanges. Such power generation systems may be both heavier in weight and may also be more expensive to manufacture because of the higher number of parts and components. For example, stress loops are used to accommodate an expansion of the pipework within the system. This additional pipework of stress loops needed to connect the various manifolds and heat exchangers together adds to the weight, installation costs, and overall cost of power generation systems.

Accordingly, one or more embodiments in the present disclosure may be used to overcome such challenges as well as provide additional advantages over conventional power generation systems, as will be apparent to one of ordinary skill. In one or more embodiments, a recuperative heat exchanger system may be lighter in weight and lower in cost as compared with conventional power generation systems due, in part, minimizing creep fatigue/damage, independent oxidant and recycle sections such that exhaust fluid flow split may be controlled with one or more low temperature valves, and exhaust fluid leaving the turbine does not require a balancing vessel to be placed between the turbine and recuperative heat exchanger. Additionally, the recuperative heat exchanger systems herein may increase reliability and performance for thousands of hours, even where some components of the recuperative heat exchanger system are subject to high pressures, high temperatures and cycles of operation. Overall, the recuperative heat exchanger system may minimize product engineering, risk associated with flow loops manufacture, reduction of assembly time, hardware cost reduction, and weight and envelope reduction.

FIG. 1 illustrates a close-up schematic view of a recuperative heat exchanger system 105 according to embodiments herein. As known in the art, a turbine may be a structure useful for extracting energy from a fluid flow and converting the fluid flow into useful work, such as to drive a generator to produce electricity, and is often a rotary device with other components (i.e., rotor, stator, and/or turbine blades) having various functions relevant to producing to mechanical energy. It is noted that the turbine in one or more embodiments may be configured as a gas or steam turbine. As known to those of ordinary skill in the art, the turbine may produce exhaust gases 104. The exhaust gases 104 may be fed into a recuperative heat exchanger system 105 (see dotted square) to form a turbine exhaust gas stream.

In some embodiments, as shown by arrows 104, exhaust gas leaving a turbine may enter a precool section 200 via one or more transfer pipes. In a non-limiting example, four nominally identical transfer pipes may be used to transfer the exhaust gas (arrows 104) to the precool section 200. It is noted that any number of transfer pipes may be used without departing from the scope of the present disclosure.

In one or more embodiments, the precool section 200 may include one or more shell and tube heat exchangers ("STHE") 201. The STHE 201 of the precool section 200 may be made from a material selected from an Inconel material (e.g. Alloy 625 or alloy 617) or a similar material that is not subject to time dependent properties at a highest temperature. The one or more transfer pipes may be connected a shell-side of the STHE 201. In a non-limiting example, each STHE 201 may have one transfer pipe connected thereof. On a tube-side of the STHE 201, the STHE 201 may receive a fluid flow (e.g., oxidant fluid) from a minor section (302*a*, 302*b*). In some embodiments, a mass heat capacity (e.g., mass flow x specific heat capacity) of a tube-side fluid of the STHE 201 may be lower than the mass heat capacity of the exhaust gas (arrows 104) entering the STHE 201 on the shell-side. Based on the lower mass heat capacity, a temperature change of the exhaust gas may be small (e.g., 15-50° C.) whilst a temperature change of an oxidant stream may be large (e.g., 100-200° C.). It is further envisioned that the STHE 201 may include a heated oxidant outlet 204 for the oxidant stream to exit. From the STHE 201, the exhaust gas may enter a manifold 205 to split the exhaust gas flow.

In some embodiments, the manifold 205 may split the exhaust gas along various flow paths. In a non-limiting example, the manifold 205 splits the exhaust gas into two flow paths such as an exhaust gas minor stream 206 and an exhaust gas major stream 207.

In the exhaust gas minor stream 206, the exhaust gas flows through the minor section having a first minor heat exchanger 302*a* and a second minor heat exchanger 302*b*. Both the first minor heat exchanger 302*a* and the second minor heat exchanger 302*b* may be a printed circuit type heat exchanger ("PCHE"), a coil wound type heat exchanger, a micro-tube heat exchanger, a diffusion bonded exchanger using stamped fins in addition to etched plates or any other type heat exchanger. In addition, both the first minor heat exchanger 302*a* and the second minor heat exchanger 302*b* may be constructed from a suitable material, such as of dual certified stainless steel 316/316L. Additionally, the first minor heat exchanger 302*a* may be operated at a higher temperature than the second minor heat exchanger 302*b*. Further, the exhaust gas may be used to preheat the minor stream 134 to 350-500° C. In some embodiments, both the first minor heat exchanger 302*a* and the second minor heat exchanger 302*b* may be used for oxidant heating. The oxidant stream may be formed by mixing an oxygen flow 112 with the minor stream 134 prior to heating the minor oxidant stream 134 against the exhaust gas stream 206.

In the exhaust gas major stream 207, the exhaust gas flows through the major section having a first major heat exchanger 301*a*, a second major heat exchanger 301*b*, and a third major heat exchanger 301*c*. Each of the major heat exchangers 301*a*, 301*b*, 301*c* may be a printed circuit type heat exchanger ("PCHE"), a coil wound type heat exchanger, a micro-tube heat exchanger, a diffusion bonded exchanger using stamped fins in addition to etched plates or any other type heat exchanger. Additionally, the first major heat exchanger 301*a* may be operated at a highest temperature in the major section while the third major heat exchanger 301*c* may operate a lowest temperature in the major section. The second major heat exchanger 301*b* may operate at a temperature between the first major heat exchanger 301*a* and the third major heat exchanger 301*c*. In addition, each of the major heat exchangers 301*a*, 301*b*, 301*c* may be constructed from a material of dual certified stainless steel 316/316L. Further, the exhaust gas major stream 207 may be used to preheat the major stream 135 to 520-650° C. In some embodiments, each of the major heat exchangers 301*a*, 301*b*, 301*c* may be used for recycle heating. Additionally, a second flow line 304 may be used to provide the turbine with a cooling flow. In a non-limiting example, the cooling flow may be a recycle gas leaving 107*a* or 301*b*. In some cases, a temperature of the cooling flow may not match a required turbine coolant temperature. In order to match the required turbine coolant temperature, hot gas or cold gas may be added to the cooling flow to raise or lower the temperature to match the required turbine coolant temperature. In some embodiments, the cooling flow may be a blended mixture from the recycle stream leaving 107*a* or 301*b* and the higher temperature recycle stream leaving 301*a*.

In some embodiments, a flow balance of the gas exhaust between the minor section (302*a*, 302*b*) and the major section (301*a*, 301*b*, 301*c*) may be controlled by flow resistances in the minor section (302*a*, 302*b*) and the major section (301*a*, 301*b*, 301*c*). In a non-limiting example, one or more valves at an outlet (i.e., a cold end) of the minor section (302*a*, 302*b*) may be used for flow balance.

In the heat recovery stream 208, recycled exhaust gas or a separate low-grade heat stream may be used to add heat at a temperature below a combustion temperature via a first recovery heat exchanger 107*a* and a second recovery heat exchanger 107*b*. In some embodiments, the recycled exhaust gas may be exhaust gas that is reheated and recycle back through the major section (301*a*, 301*b*, 301*c*) and/or the minor section (302*a*, 302*b*). Both the first recovery heat exchanger 107*a* and the second recovery heat exchanger 107*b* may be a printed circuit type heat exchanger ("PCHE"), a coil wound type heat exchanger, a micro-tube heat exchanger, a diffusion bonded exchanger using stamped fins in addition to etched plates or any other type heat exchanger. In addition, both the first recovery heat exchanger 107*a* and the second recovery heat exchanger 107*b* may be constructed from a suitable material, such as dual certified stainless steel 316/316L. Further, the first recovery heat exchanger 107*a* may be at a higher temperature than the second recovery heat exchanger 107*b*. In some embodiments, the first recovery heat exchanger 107*a* and the second recovery heat exchanger 107*b* may be integrated into the second major heat exchanger 301*b* and the third major heat exchanger 301*c*, respectively.

In one or more embodiments, the precool section 200 may cool the exhaust gas. In a non-limiting example, the exhaust gas 104 may be precooled to a temperature of 575° C. By precooling the exhaust gas 104 to 575° C., an available temperature difference for first major heat exchanger 301*a* may be reduced. This may be compensated for by using additional heat transfer surface area, or by increasing the overall heat transfer coefficient. The product of the overall heat transfer coefficient and the heat transfer surface area may be called UA which is equivalent to the heat duty divided by the mean temperature difference LMTD which may be calculated from the inlet and outlet temperatures of the hot stream and cold stream. The UA value of a heat exchanger may be related to the cost of the heat exchanger. By including the precool section 200 in the recuperative heat exchanger system 105, the required UA may increase overall by about 15%. However, a difference in cost (e.g., a value of cost/UA) between the high temperature sections and low temperature sections may lower an overall cost of the recuperative heat exchanger system 105. In a non-limiting example, the value of cost/UA of systems above 575° C. may be more than 30% higher than the value of cost/UA of systems below 575° C. The recuperative heat exchanger system 105 may provide a lower value of cost/UA by increasing an expected life of equipment and reduced material use owing to a higher allowable stress for heat exchangers below 575° C. Although the Inconel material of the precool section 200 may be a more expensive material, the amount of material required is relatively small because of the higher LMTD in the precool section 200, which reduces the required UA.

Figure 2A:
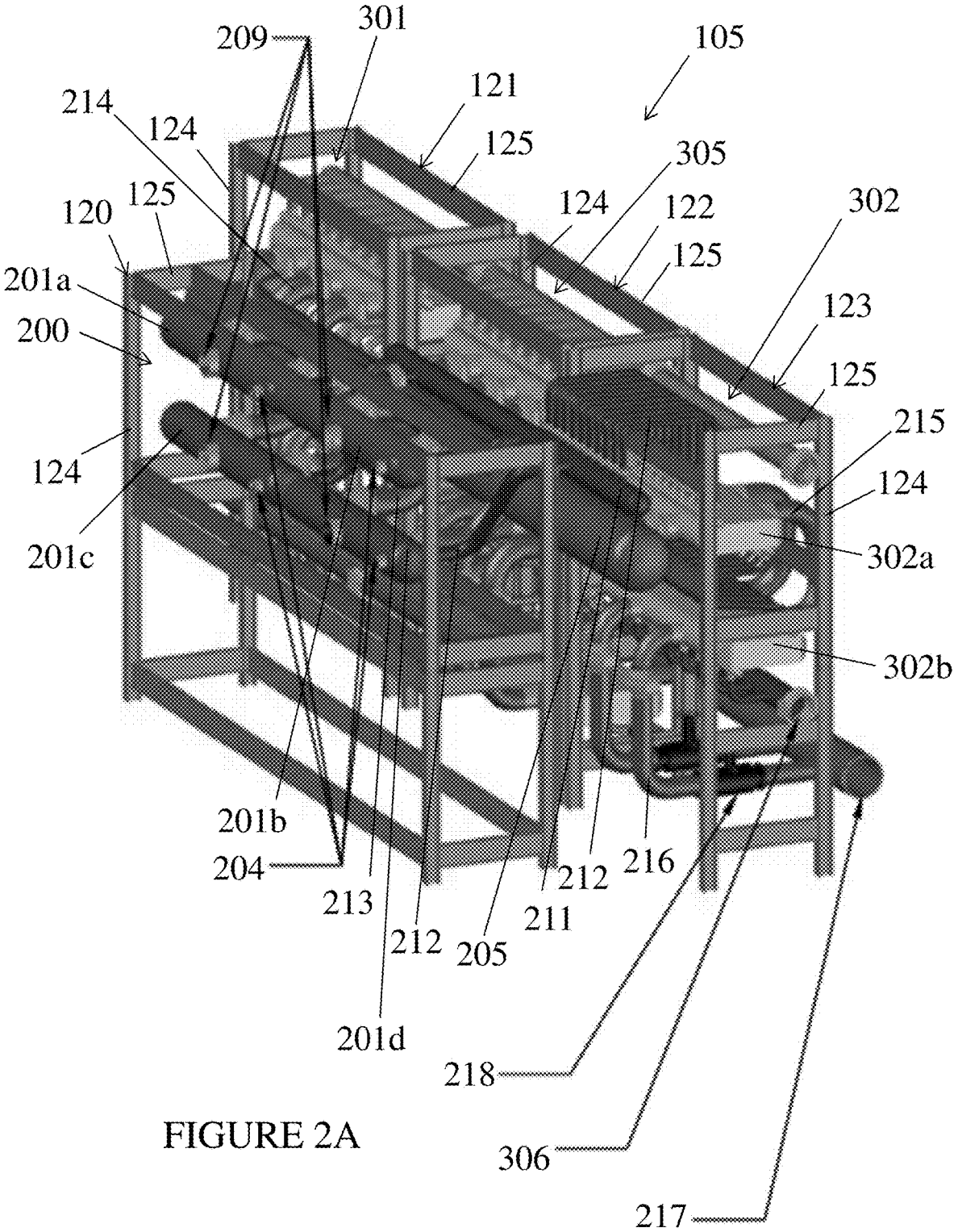
FIGS. 2A and 2B illustrate a perspective view of a recuperative heat exchanger system in accordance with one or more embodiments of the present disclosure.

Now referring to FIG. 2A, in one or more embodiments, FIG. 2A illustrates a perspective view of the recuperative heat exchanger system 105. Various components of the recuperative heat exchanger system 105 may be installed in a top-down configuration within one or more rigid frameworks (120, 121, 122, 123). A top-down configuration may have an arrangement such that the components of the recuperative heat exchanger system 105 that operate at a highest temperature are positioned at a vertically upward-most position while the components of the recuperative heat exchanger system 105 that operate at a lowest temperate are positioned at a vertically downward-most position. In a non-limiting example, a precool section 200 may be within a first rigid framework 120, a first major section 301 may be within a second rigid framework 121, a second major section 305 may be within a third rigid framework 122, and a minor section 302 may be within a fourth rigid framework 123. Each of the rigid frameworks 120, 121, 122, 123 may be made from a plurality of vertically oriented structural members 124 and a plurality of horizontally oriented structural members 125. In a non-limiting example, the plurality of vertically oriented structural members 124 and the plurality of horizontally oriented structural members 125 may be interconnected together to form a rectangular frame around various components of the recuperative heat exchanger system 105. It is further envisioned that the plurality of vertically oriented structural members 124 and the plurality of horizontally oriented structural members 125 may be angled at any degree without departing from the scope of the present disclosure. The plurality of vertically oriented structural members 124 and the plurality of horizontally oriented structural members 125 may be made from a metal material such as steel, stainless steel, iron, or any other type of metal.

In some embodiments, the precool section 200 may include one or more shell and tube heat exchangers ("STHE") 201*a*, 201*b*, 201*c*, 201*d* inside the first rigid framework 120. In a non-limiting example, a first STHE 201*a*, a second STHE 201*b*, a third STHE 201*c*, and a fourth STHE 201*d* may be positioned in parallel. In addition, all four STHE 201*a*, 201*b*, 201*c*, 201*d* may operate at substantially the same temperature. It is further noted the while four STHE 201*a*, 201*b*, 201*c*, 201*d* are shown in FIG. 2A, this is merely for example purposes only and any number of STHE may be used without departing from the present scope of the disclosure. All four STHE 201*a*, 201*b*, 201*c*, 201*d* may be made from a material selected from an Inconel material (e.g. Alloy 625 or alloy 617) or a similar material that is not subject to time dependent properties at a highest design operating temperature. Additionally, precooler inlets 209 may be provided on each STHE 201*a*, 201*b*, 201*c*, 201*d* to receive exhaust gases from a turbine. Each precooler inlet 209 may have a transfer pipe connected thereof from the turbine, such that a number of transfer pipes may match in ratio to a number of STHE. Further, on each STHE 201*a*, 201*b*, 201*c*, 201*d*, outlets 204 may be provided to allow for heated oxidant to exit the precool section 200.

On each STHE 201*a*, 201*b*, 201*c*, 201*d*, inlets 212 may be provided to allow for heated oxidant to enter the precool section 200 from the minor section 302. In a non-limiting example, an oxidant manifold 211 may be provided between the minor section 301 and the precool section 200. Oxidant flow lines 212 may be connected to the inlets 210 of each STHE 201*a*, 201*b*, 201*c*, 201*d* from the oxidant manifold 211 and the minor section 302. In addition, an oxidant inlet 306 may be provided in the fourth rigid framework 123 to allow oxidant flow to connect to the minor section 302. Additionally, on the tube-side, the exhaust gas exits each STHE 201*a*, 201*b*, 201*c*, 201*d* to enter a manifold 205 via flow tubes 213. The manifold 205 may be positioned outside of the one or more rigid frameworks (120, 121, 122, 123) and downstream of the precool section 200 with respect to the exhaust flow.

In some embodiments, the manifold 205 may be used to split the exhaust gas flow to the minor section 302, the first major section 301, and the second major section 305. Flow loops 214 may be used as conduit for the exhaust gas to flow from the manifold 205 to the minor section 302, the first major section 301, and the second major section 305. In a non-limiting example, the flow loops 214 may extend from the manifold 205 to individual heat exchangers (301*a*, 302*a*, 305*a*) with each of the minor section 302, the first major section 301, and the second major section 305.

In the minor section 302, the exhaust gas flows through the flow loops 214 to a first heat exchanger 302*a* and then a second heat exchanger 302*b*. In a non-limiting example, one or more curved flow loops 215 may be used as a conduit for the exhaust gas to flow from the first heat exchanger 302*a* to the second heat exchanger 302*b*. In addition, secondary curved flow loops 216 may be used to flow the exhaust gas from the second heat exchanger 302*b* to an exhaust gas manifold 217 of the recuperative heat exchanger system 105. Further, the secondary curved flow loops 216 may be provided with one or more flow balance valves 218. With the top-down configuration, the first heat exchanger 302*a* may be operated at a higher temperature then the second heat exchanger 302*b*. In one or more embodiments, the uppermost exchanger may be subject to higher temperature and therefore critical that the uppermost exchanger may be accessed for maintenance and inspection. Additionally, the uppermost heat exchanger may free to expand as far as possible without being constringed by connections to the other heat exchangers.

Figure 2B:
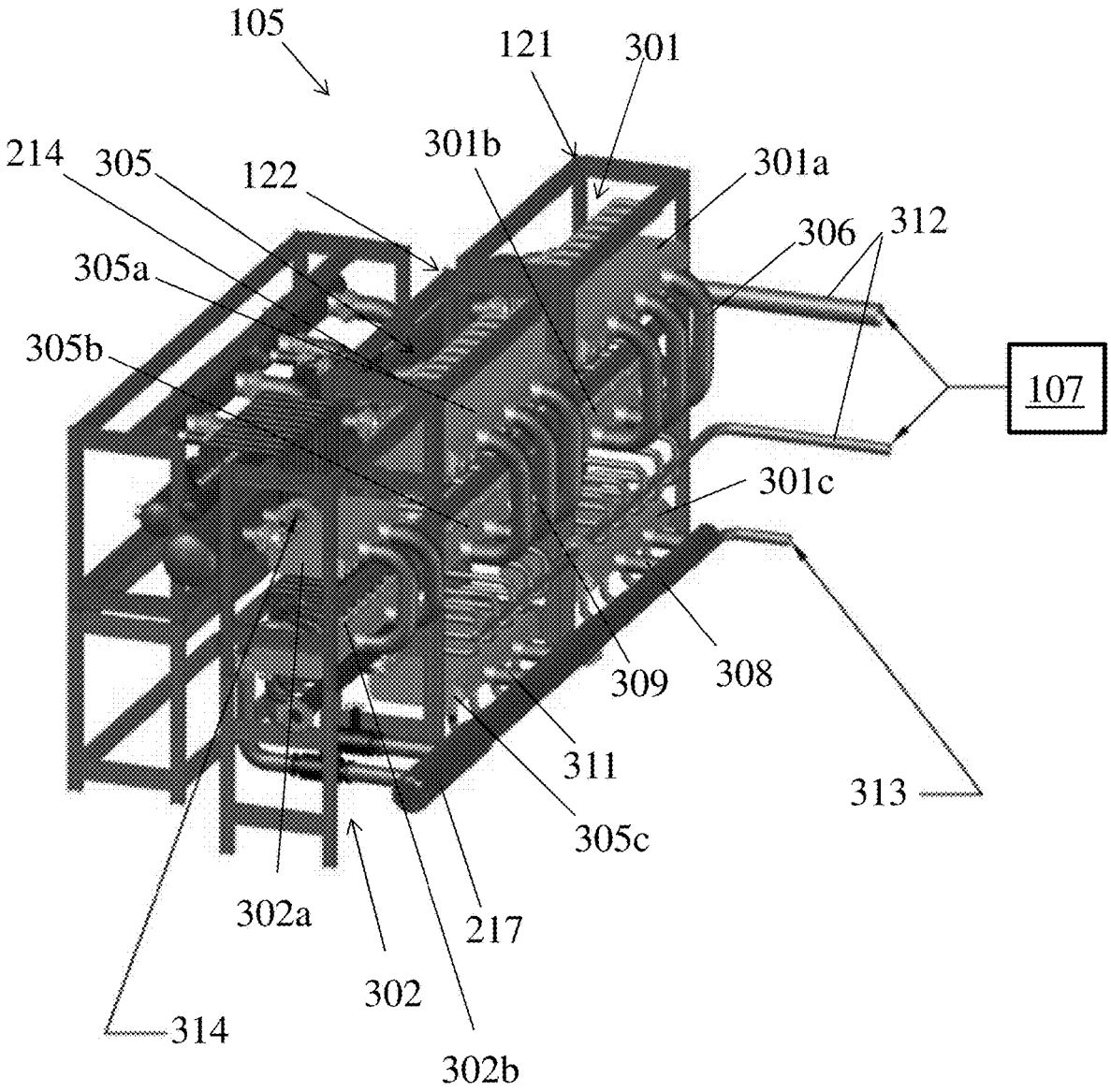

Referring to FIG. 2B, in one or more embodiments, a perspective view of the recuperative heat exchanger system 105 taken from 90-degree counter-clockwise turn of FIG. 2A is illustrated. In the first major section 301, the exhaust gas flows through the flow loops 214 to a first heat exchanger 301*a* to then flow to a second heat exchanger 301*b* and then to a third recycled heat exchanger 301*c*. In a non-limiting example, one or more curved flow loops 306 may be used as a conduit for the exhaust gas to flow from the first heat exchanger 301*a* to the second heat exchanger 301*b*. In addition, secondary curved flow loops may be used to flow the exhaust gas from the second heat exchanger 301*b* to the third heat exchanger 301*c*. Further, flow tubes 308 may be used to flow the exhaust gas to the exhaust gas manifold 217 from the third recycled heat exchanger 302*c*. With the top-down configuration, the first heat exchanger 301*a* may operate at a highest temperature while the third heat exchanger 301*c* may operate at a lowest temperature. The second heat exchanger 301*b* may operate at a temperature between the first heat exchanger 301*a* and the third heat exchanger 301*c*.

In one or more embodiments, the second major section 305 may have an arrangement identical to the first major section 302. For example, the exhaust gas flows through the flow loops 214 to a first heat exchanger 305*a* to then flow to a second heat exchanger 305*b* and then to a third heat exchanger 305*c*. Additionally, one or more curved flow loops 309 may be used as a conduit for the exhaust gas to flow from the first heat exchanger 305*a* to the second heat exchanger 305*b*. In addition, secondary curved flow loops (see 310 in FIG. 2C) may be used to flow the exhaust gas from the second heat exchanger 305*b* to the third heat exchanger 305*c*. Further, flow tubes 311 may be used to flow the exhaust gas to the exhaust gas manifold 217 from the third heat exchanger 305*c*. With the top-down configuration, the first heat exchanger 305*a* may operate at a highest temperature while the third heat exchanger 305*c* may operate at a lowest temperature. The second heat exchanger 305*b* may operate at a temperature between the first heat exchanger 305*a* and the third heat exchanger 305*c*.

Still referring to FIG. 2B, a heat recovery section 107 may be connected to the first major section 301 and the second major section 305 via heat recovery tubes 312. The heat recovery tubes 312 may be provided between the first heat exchanger 301*a*, 305*a* and the second heat exchanger 301*b*, 305*b* as well as between the second heat exchanger 301*b*, 305*b* and the third heat exchanger 301*c*, 305*c* of the first major section 301 and the second major section 305. It is further envisioned that a recycled CO2 inlet 313 may be provided at a bottom of the first major section 301 and the second major section 305. From the recycled CO2 inlet 313, recycled CO2 may travel through a recycled CO2 manifold (see 315 in FIG. 2C) to be distributed to the third heat exchanger 301*c*, 305*c*, the second heat exchanger 301*b*, 305*b* and the first heat exchanger 301*a*, 305*a* to be heated and then exit through a hot recycled CO2 manifold 314.

Figure 2C:
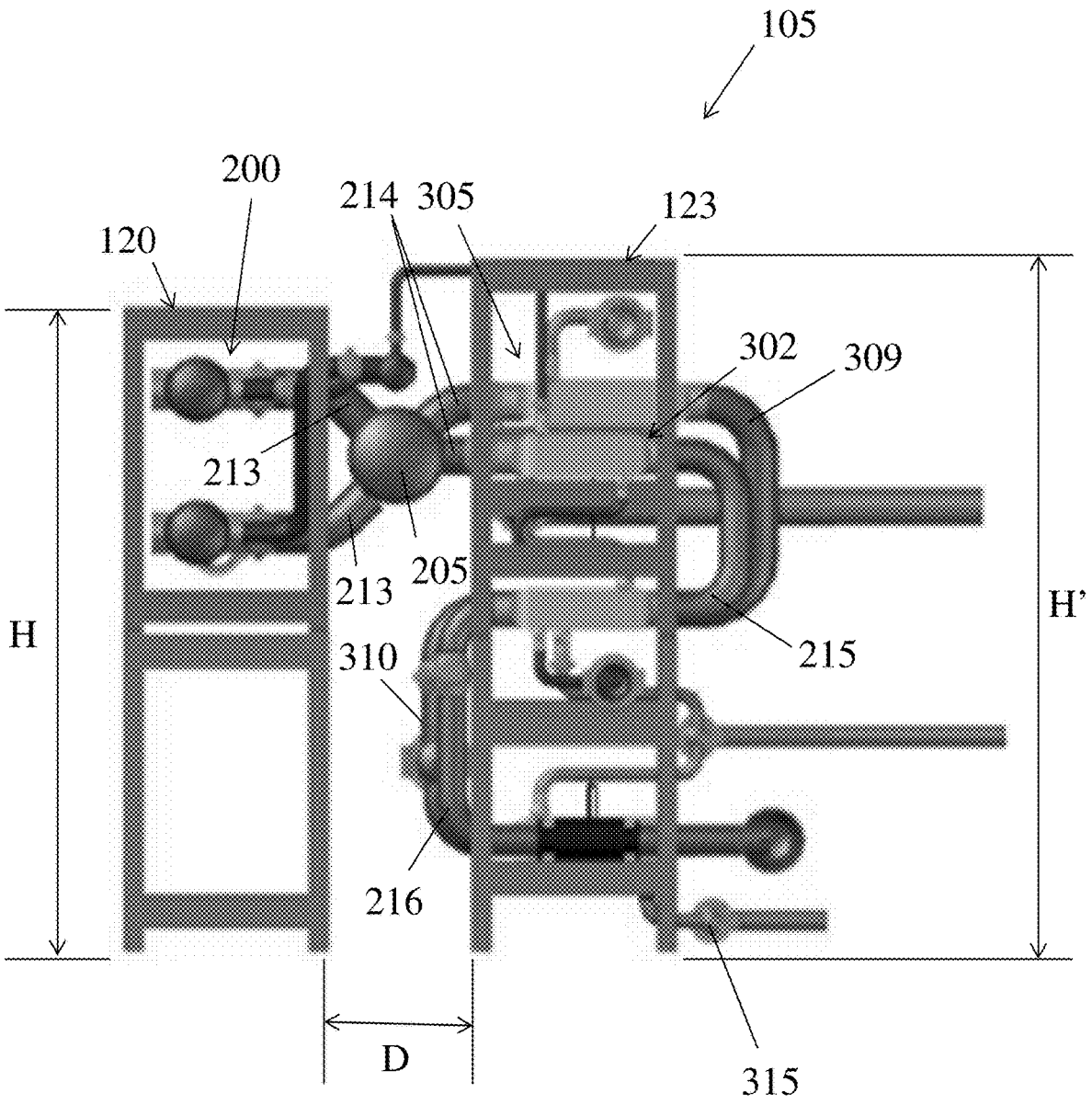
FIG. 2C is a side view of the recuperative heat exchanger system of FIGS. 2A and 2B in accordance with one or more embodiments of the present disclosure.

Now referring to FIG. 2C, a side view of the recuperative heat exchanger system 105 from FIGS. 2A and 2B is illustrated in accordance with one or more embodiments of the disclosure. As shown by FIG. 2C, the first rigid framework 120 for the precool section 200 may be spaced a distance D from the second rigid framework (see 121 in FIGS. 2A and 2B) for the first major section (see 301 in FIGS. 2A and 2B), the third rigid framework (see 122 in FIGS. 2A and 2B) for the second major section 305, and the fourth rigid framework 123 for the minor section 302. In a non-limiting example, the manifold 205 may be positioned in the space created by the distance D between the first rigid framework 120 and the other rigid frameworks (121, 122, 123). Further, a height H of the first rigid framework 120 may be less than a height H' of the other rigid frameworks (121, 122, 123).

In one or more embodiments, the curved flow loops 215, 309 and the secondary curved flow loops 216, 310 in each of the minor section 302, the first major section (301), and the second major section 305 may have a portion that extends out of the corresponding rigid frameworks (121, 122, 123). In this configuration, the curved flow loops and the secondary curved flow loops are more flexible than linear connection and may expand with minimized restraint.

Figure 2D:
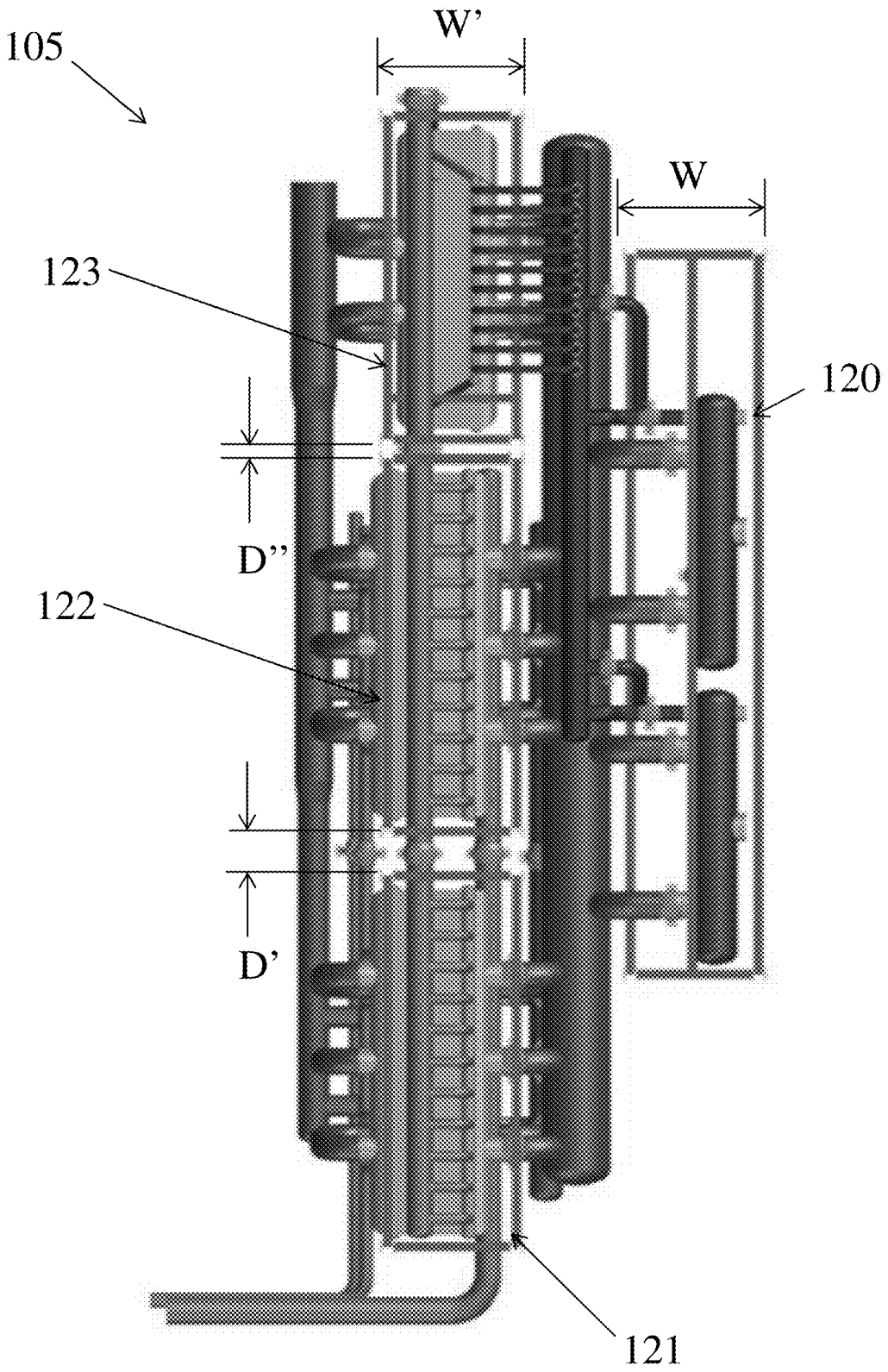
FIG. 2D is a top view of the recuperative heat exchanger system of FIGS. 2A and 2B in accordance with one or more embodiments of the present disclosure.

Now referring to FIG. 2D, a top view of the recuperative heat exchanger system 105 from FIGS. 2A and 2B is illustrated in accordance with one or more embodiments of the disclosure. As shown by FIG. 2D, a width W of the first rigid framework 120 may be equal to a width W' of the second rigid framework 121, the third rigid framework 122, and the fourth rigid framework 123. The second rigid framework 121 may be spaced a distance D' from the third rigid framework 122. The third rigid framework 122 may be spaced a distance D" from the fourth rigid framework 123. In a non-limiting example, the distance D' may be larger than the distance D". FIGS. 2C and 2D illustrate examples of how each of the rigid frameworks (120, 121, 122, 123) may have various dimensions (height and width) such that the components of the recuperative heat exchanger system 105 may be easily positioned adjacent to each other to allow for fluids connections.

As shown in FIGS. 2A-2D, in one or more embodiments, the various components (the precool section 200, the minor section 302, the first major section 301, and the second major section 305) of the recuperative heat exchanger system 105 having the top-down configuration may allow for a modular and compact system. By having the top-down configuration, a footprint for the recuperative heat exchanger system 105 may be much smaller than for a conventional linear system installed at grade. In a non-limiting example, the footprint for the entire recuperative heat exchanger system 105 may be around 11 feet by 14 feet. It is further envisioned that the footprint may be any dimensional size without departing from the present disclosure. Additionally, the footprint may be based on operation and transportation requirements such as special route considerations due to bridge heights and size limitations based on truck, rail, and ship lengths.

Additionally, the recuperative heat exchanger system 105 may allow for high temperature pipe to and from the turbine to not need to be run down to grade. Further each of the precool section 200, the minor section 302, the first major section 301, and the second major section 305 may be constructed in a modular and compact design to allow for easy manufacturing and shipping to the field with a minimum number of field connections. In one or more embodiments, each of the precool section 200, the minor section 302, the first major section 301, and the second major section 305 is supported within the corresponding rigid frameworks (120, 121, 122, 123) and allow for independent expansion within the corresponding rigid frameworks (120, 121, 122, 123). Since the corresponding rigid frameworks (120, 121, 122, 123) do not constrain expansion of the precool section 200, the minor section 302, the first major section 301, and the second major section 305 under thermal load, routing of connecting pipes to provide enough flexibility may be greatly simplified. This is especially important for heat exchangers that transition from a rigid block to a flexible header and nozzle assembly. It is further envisioned that, because the high temperature heat exchangers experiencing the highest thermal expansion loads may be located at the upward most position, where the modules will have the most flexibility, the high temperature heat exchangers may be the most accessible for inspection or repair. Furthermore, condensate from high temperature heat exchangers or other sections may naturally drain downward from the recuperative heat exchanger system 105.

Control systems may be provided to operate the recuperative heat exchanger system 105 locally or remotely. Embodiments herein for operating the recuperative heat exchanger system 105 may be implemented on a computing system. Any combination of mobile, desktop, server, router, switch, embedded device, or other types of hardware may be used with the recuperative heat exchanger system 105. For example, the computing system may include one or more computer processors, non-persistent storage (e.g., volatile memory, such as random access memory (RAM), cache memory), persistent storage (e.g., a hard disk, an optical drive such as a compact disk (CD) drive or digital versatile disk (DVD) drive, a flash memory, etc.), a communication interface (e.g., Bluetooth interface, infrared interface, network interface, optical interface, etc.), and numerous other elements and functionalities. It is further envisioned that software instructions in a form of computer readable program code to perform embodiments of the disclosure may be stored, in whole or in part, temporarily or permanently, on a non-transitory computer readable medium such as a CD, DVD, storage device, a diskette, a tape, flash memory, physical memory, or any other computer readable storage medium. For example, the software instructions may correspond to computer readable program code that, when executed by a processor(s), is configured to perform one or more embodiments of the disclosure.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed:

1. A recuperative heat exchanger system, comprising:

a first rigid framework;

a precool section within the first rigid framework, wherein the precool section includes one or more heat exchangers configured to receive and cool an exhaust gas and output a cooled exhaust gas flow;

a second rigid framework;

a minor section within the second rigid framework, wherein the minor section includes a first minor heat exchanger and a second minor heat exchanger;

a third rigid framework;

a first major section within the third rigid framework, wherein the first major section includes a first major heat exchanger, a second major heat exchanger, and a third major heat exchanger; and a manifold configured to split the cooled exhaust gas flow from the precool section between a minor stream and a major stream, wherein the minor stream is provided to the minor section and the major stream is provided to the first major section.

2. The recuperative heat exchanger system of claim 1, wherein the manifold is positioned outside of the first rigid framework.

3. The recuperative heat exchanger system of claim 1, further including a space between the first rigid framework and the second and third rigid frameworks, wherein the manifold is positioned in the space.

4. The recuperative heat exchanger system of claim 1, further comprising:

a fourth rigid framework;

a second major section within a the fourth rigid framework, wherein the second major section includes a fourth major heat exchanger, a fifth major heat exchanger, and a sixth major heat exchanger.

5. The recuperative heat exchanger system of claim 4, further comprising:

one or more valves to balance a split of the cooled exhaust gas flow to the first major section, the second major section, and the minor section.

6. The recuperative heat exchanger system of claim 4, further comprising:

a heat recovery section connected to the first major section and the second major section.

7. The recuperative heat exchanger system of claim 4, wherein each of the first rigid framework, the second rigid framework, the third rigid framework, and the fourth rigid framework include a plurality of vertically oriented structural members and a plurality of horizontally oriented structural members interconnected together.

8. The recuperative heat exchanger system of claim 1, wherein the one or more shell and tube heat exchangers include precooler inlets on a shell-side to receive the exhaust gases.

9. The recuperative heat exchanger system of claim 1, further comprising:

a first recycle CO2 manifold to provide recycled CO2 within the recuperative heat exchanger system.

10. The recuperative heat exchanger system of claim 9, further comprising:

a second recycle CO2 manifold to exit the recycled CO2 within the recuperative heat exchanger system.

11. The recuperative heat exchanger system of claim 1, wherein the one or more shell and tube heat exchangers include oxidant inlets on a tube-side to receive oxidant from the minor section.

12. The recuperative heat exchanger system of claim 1, wherein the one or more shell and tube heat exchangers include precooler inlets on a shell-side to receive the exhaust gases and oxidant inlets on a tube-side to receive oxidant from the minor section.

13. A method, comprising:

cooling an exhaust gas with a precool section within a first rigid framework, including outputting a cooled exhaust gas flow from the precool section;

splitting the cooled exhaust gas flow with a manifold positioned outside of the first rigid framework into a major stream and a minor stream, including providing the major stream to a first major section within a second rigid framework and providing the minor stream to a minor section within a third rigid framework;

flowing the minor stream through a first minor heat exchanger of the minor section and through a second minor heat exchanger of the minor section via one or more first curved flow loops;

flowing the major stream through a first major heat exchanger of the first major section, through a second major heat exchanger of the first major section, and then through a third major heat exchanger of the first major section via one or more second curved flow loops; and flowing an effluent from the second minor heat exchanger of the minor section and the third major heat exchanger of the first major section to an exhaust gas manifold via secondary curved flow loops.

14. The method of claim 13, further comprising:

operating the first minor heat exchanger at a higher temperature than the second minor heat exchanger.

15. The method of claim 13, further comprising:

operating the first major heat exchanger of the first major section at a higher temperature than the second major heat exchanger of the first major section, and operating the second major heat exchanger of the first major section at a higher temperature than third major heat exchanger of the first major section.

16. The method of claim 13, further comprising, after the following the major stream through the first, second, and third major heat exchangers of the first major section:

flowing an effluent from the first major section through a first major heat exchanger of a second major section, through a second major heat exchanger of the second major section, and a through third major heat exchanger of the second major section.

17. The method of claim 16, further comprising:

distributing recycled CO2, via a first recycled CO2 manifold, to the first major section and the second major section.

18. The method of claim 17, further comprising:

heating the recycled CO2 with the first major section and the second major section and exiting the heated recycled CO2 with a second recycled CO2 manifold.

19. The method of claim 13, further comprising:

providing an oxidant to the precool section via an oxidant manifold.

20. The method of claim 13, further comprising:

providing heat to the first major section and the second major section via a heat recovery section.

* * * * *